US007063560B2

(12) United States Patent
Asao

(10) Patent No.: US 7,063,560 B2
(45) Date of Patent: Jun. 20, 2006

(54) CONNECTOR FOR CONDUCTOR-PATH SHEET, A CONNECTOR ASSEMBLY AND A CONNECTOR ASSEMBLING METHOD

(75) Inventor: Kazuhiro Asao, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 10/844,011

(22) Filed: May 12, 2004

(65) Prior Publication Data

US 2004/0229506 A1 Nov. 18, 2004

(30) Foreign Application Priority Data

May 14, 2003 (JP) ..... 2003-136061

(51) Int. Cl.
*H01R 12/24* (2006.01)

(52) U.S. Cl. ..... 439/496; 439/596; 439/936

(58) Field of Classification Search ..... 439/77, 439/274, 275, 271, 204, 206, 495, 497, 587, 439/596, 936

See application file for complete search history.

(56) References Cited

U.S. PATENT DOCUMENTS

| | | | | |
|---|---|---|---|---|
| 3,141,720 | A * | 7/1964 | Johnson | 439/496 |
| 3,144,288 | A * | 8/1964 | Grant | 439/496 |
| 3,278,887 | A * | 10/1966 | Travis | 439/496 |
| 4,875,870 | A | 10/1989 | Hardy et al. | |
| 6,113,407 | A * | 9/2000 | Martin | 439/205 |
| 6,520,797 | B1 * | 2/2003 | Okamura et al. | 439/495 |
| 6,533,588 | B1 * | 3/2003 | Woith et al. | 439/67 |

FOREIGN PATENT DOCUMENTS

JP 2000-188145 7/2000

* cited by examiner

*Primary Examiner*—Khiem Nguyen
(74) *Attorney, Agent, or Firm*—Gerald E. Hespos; Anthony J. Casella

(57) ABSTRACT

A housing (21) is formed with an insertion path (24) for an FFC (10). Thick gel plates (45) are mounted on front and rear surfaces of the FFC (10) beforehand. The gel plates (45) are pushed into an entrance (25) to the insertion path (24) as the FFC (10) is inserted, thereby providing sealing at a place where an end portion of the FFC (10) is inserted into the entrance (25). The gel plates (45) adhere well even to corners of the FFC (10) to display a waterproof function. Therefore, the FFC (10) can be used at a place exposed to water.

8 Claims, 9 Drawing Sheets

CONNECTOR FOR CONDUCTOR-PATH SHEET, A CONNECTOR ASSEMBLY AND A CONNECTOR ASSEMBLING METHOD

BACKGROUND OF THE INVENTION

1. Field of the Invention

The invention relates to a connector used to accommodate an end of a conductor-path sheet, to a connector assembly and to a method of assembling such connector.

2. Description of the Related Art

A flexible flat cable (FFC) is one example of a conductor-path sheet. The FFC is a flexible ribbon formed by laying conductive paths in parallel on a strip of insulating film. A protection film then is applied to the upper surfaces of the conductor paths, except for end portions of the conductor paths. One end portion of the FFC is accommodated in a connector housing and the connector housing is connected with a mating connector housing. Thus, the respective conductor paths are connected with corresponding terminal fittings in the mating connector housing. A connector for an FFC is disclosed, for example, in Japanese Unexamined Patent Publication No. 2000-188145.

A conductor-path sheet, such as the aforementioned FFC, requires a smaller layout space than a wiring harnesses formed by bundling wires. Thus, consideration is being given to using conductor-path sheets in place of wiring harnesses. However, conductor-path sheets require sealing for use in areas that are exposed to water, such as in an engine compartment of an automotive vehicle. Sealing may be required, for example, at a portion where the ends of the conductor-path sheet are inserted in a connector housing. However, since the ends of the conductor-path sheet have a rectangular cross section, and it is difficult to provide sealing for corners of the conductor-path sheet. Therefore, conductor-path sheets currently are not used in areas exposed to water.

The invention was developed in view of the above problem and an object thereof is to provide a waterproof connector for conductor-path sheet.

SUMMARY OF THE INVENTION

The invention relates to a connector for a conductor-path sheet that has conductor paths arranged on or in an insulating sheet. The connector includes a housing for accommodating an end portion of the conductor-path sheet so that the respective conductor paths are connectable with terminal fittings in a mating housing by connecting the housing with the mating housing. The housing has an insertion opening into which the end portion of the conductor-path sheet is insertable. A seal is mounted on the outer peripheral surface of the end portion of the conductor-path sheet beforehand. The end portion of the conductor-path sheet is accommodated into the housing so that the seal is fit substantially in close contact with the inner peripheral surface of the insertion opening.

The seal preferably is made of a soft or resilient or compressible material. Thus, the inner surface of the seal is adhered well even to corner portions of the end portion of the conductor-path sheet. The seal is fit so that the outer peripheral surface thereof is held in close contact with the inner peripheral surface of the insertion opening, thereby displaying a sufficient waterproof function at a place where the end portion of the conductor-path sheet is inserted into the housing. Therefore, the conductor-path sheet can be used in areas exposed to water. Further, the seal is mounted on the end portion of the conductor-path sheet beforehand and is fit into the insertion opening as the conductor-path sheet is inserted. Thus, an assembling process of the connector can be simplified.

The seal preferably comprises a pair of gel plates and the gel plates preferably are mounted tightly on front and rear surfaces and/or sides of the end portion of the conductor-path sheet.

The gel plates adhere well to the outer peripheral surface of the end portion of the conductor-path sheet, including corners. As a result, a secure waterproofed state can be attained.

The seal preferably comprises a resilient ring formed on the outer peripheral surface of the end portion of the conductor-path sheet by molding. Thus, the resilient ring is secured well to the outer peripheral surface of the end portion of the conductor-path sheet including corners.

The seal may comprise a ring made of a thermoplastic elastomer and formed with an introducing opening through which the end portion of the conductor-path sheet is introduced. Heating may be applied with the end portion of the conductor-path sheet introduced through the introducing opening of the ring member. Thus, the inner peripheral surface of the introducing opening is at least partly molten and is secured to the outer peripheral surface of the end portion of the conductor-path sheet.

The housing preferably is fit into the mating housing via a seal ring to form a sealed space between the two housings.

An opening preferably is formed in an outer surface of the housing and/or the mating housing and communicates with a sealed space between the housings, and an air-permeable film for permitting the passage of gases while shutting off the passage of fluids preferably is provided at the opening.

Air in the sealed space expands or contracts to deform the connector housings in response to a temperature difference between the inside and the outside of the connector with the housings are connected to form the sealed space. Thus, there is a possibility that such deformation will create clearances between the seal and the insertion opening and the adhered portion of the conductor-path sheet.

Air preferably can flow through the air-permeable film. Thus, air in the sealed space neither expands nor contracts even though a temperature difference may exist between the inside and the outside of the connector. As a result, the housings will not deform and seal will not disengage. The entry of water is hindered by the air-permeable film. Therefore, a waterproofed state between the housings is maintained.

A retainer preferably is provided on or in the housing for retaining the conductor-path sheet in a proper position with respect to the housing.

The conductor-path sheet preferably is fixed in the housing while being held at two positions spaced along a longitudinal direction of the conductor-path sheet between portions of the retainer and the housing.

The invention also relates to a method of assembling a connector for conductor-path sheet. The method comprises mounting a seal on the outer peripheral surface of an end portion of the conductor-path sheet beforehand, and accommodating the end portion of the conductor-path sheet through the insertion opening in a connector housing. Thus, the seal is fit in close contact with the inner peripheral surface of the insertion opening.

The method may comprise mounting at least one gel plate on front and rear surfaces of the end portion of the conductor-path sheet.

The method may comprise molding a resilient seal on the outer peripheral surface of the end portion of the conductor-path sheet.

The method preferably comprises mounting a sealing ring made of a thermoplastic elastomer and formed with an introducing opening through which the end portion of the conductor-path sheet is introduced.

The method comprises heating the end portion of the conductor-path sheet introduced through the introducing opening of the ring member. Thus, at least the inner peripheral surface of the introducing opening is molten and substantially adhered to the outer peripheral surface of the end portion of the conductor-path sheet.

These and other features of the invention will become more apparent upon reading the following detailed description of preferred embodiments and accompanying drawings. Even though embodiments are described separately, single features may be combined with additional embodiments.

DETAILED DESCRIPTION OF THE PREFERRED EMBODIMENTS

A connector according to a first embodiment of the invention is identified by the numeral 20 in FIGS. 1 to 8. The connector 20 is constructed so that an end portion of a FFC 10 (flexible flat cable), as an example of a conductor-path sheet, is connectable with a mating circuit board connector 50 mounted on a printed circuit board 17.

Figure 6:
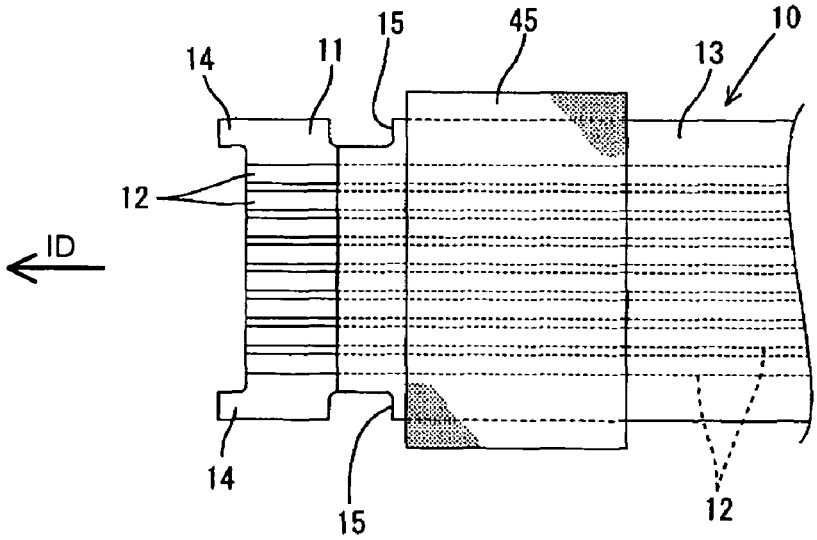
FIG. 6 is a plan view of a FFC having gel plates mounted thereon.

As shown in FIG. 6, the FFC 10 is formed into a flexible ribbon by covering a plurality of conductor paths 12 formed on the surface of a strip-shaped insulating film 11 at specified intervals by printing from above by means of a projection film 13. The protection film 13 is stripped over a specified range at an end of the FFC 10, thereby exposing ends portions of the respective conductor paths 12. Projections 14 are formed at the end of the FFC 10, and notches 15 are formed at positions of the lateral edges behind an area where the conductive paths 12 are exposed.

Figure 3:
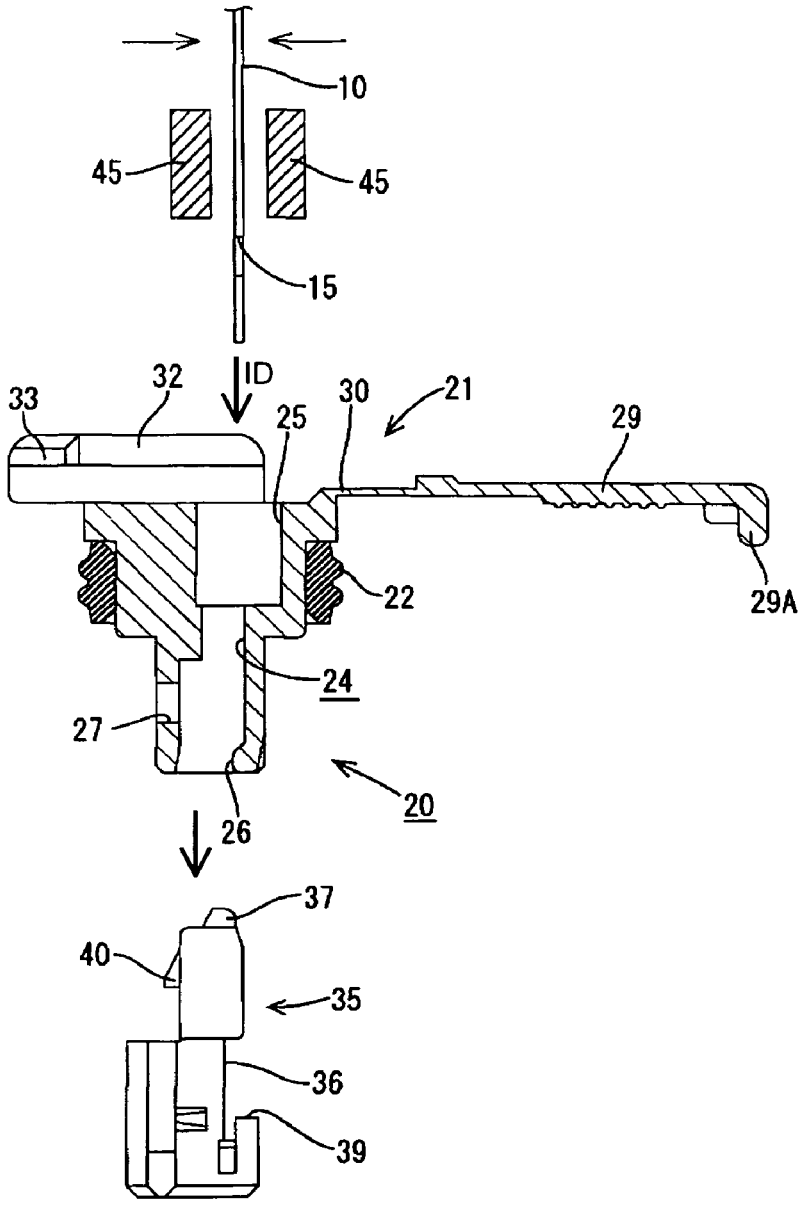
FIG. 3 is an exploded side view partly in section of the connector for conductor-path sheet.
Figure 4:
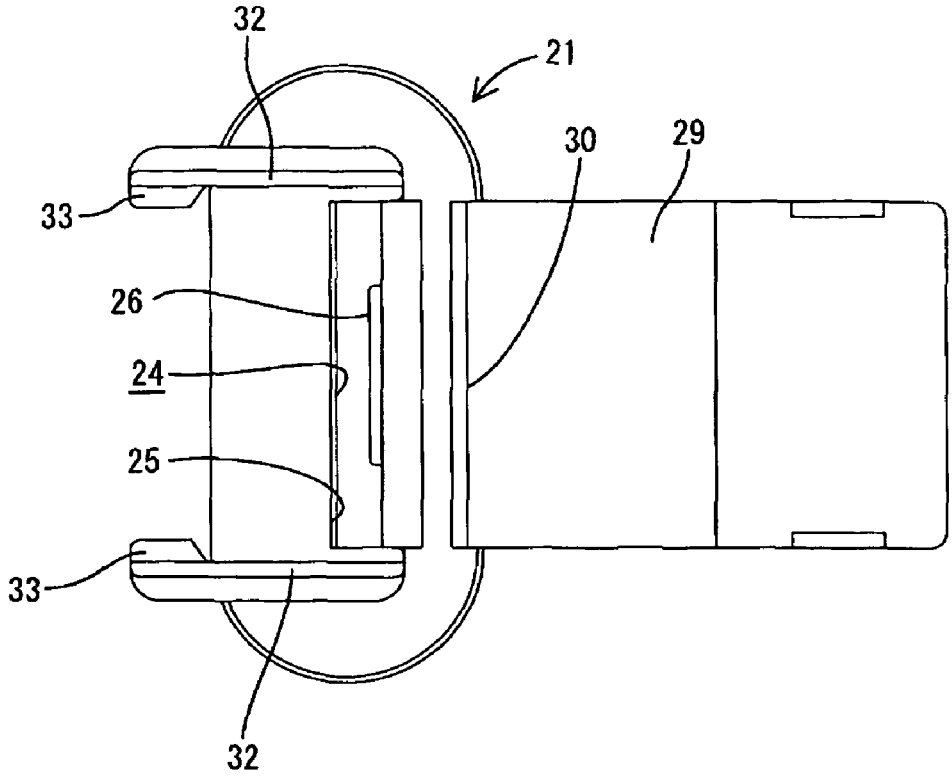
FIG. 4 is a plan view of a housing.

The connector 20, as shown in FIG. 3, has a housing 21 and a retainer 35 made e.g. of a synthetic resin.

The housing 21 is a stepped block having three stages of different cross sectional areas which are reduced from the upper end toward the bottom end. The upper and middle stages of the housing 21 have rounded cross sections and the lower stage has a substantially rectangular cross section. A seal ring 22 is mounted on the outer peripheral surface of the middle stage of the housing 21.

An insertion path 24 for the FFC 10 penetrates the opposite upper and lower surfaces of the housing 21. Specifically, the insertion path 24 has a wide entrance 25 at a position near one shorter side (right side in FIG. 4) of the upper surface of the housing 21. The width of the insertion path 24 is narrowed by the lateral wall surface (right wall surface of FIG. 3) bulging inwardly at an intermediate position and is widened at the bottom end by the retracted opposite lateral wall surface (left wall surface of FIG. 3). A protrusion 26 is formed at the bottom of the right side wall of the insertion path 24, and a locking hole 27 is formed in the opposite left side wall.

The housing 21 is formed unitarily with a cover 29 for covering the upper surface of the housing 21. The cover 29 is a strip having substantially the same width as the insertion path 24 for the FFC 10 and extends laterally (rightward in FIG. 3) via a hinge 30 from one lateral edge (right edge of FIG. 3) of the upper surface of the housing 21. An operable portion 29A projects at an extending end of the outer surface of the cover 29. The cover 29 is foldable at the hinge 30 to cover a middle part of the upper surface of the housing 21 including the entrance 25 of the insertion path 24.

Two guiding projections 32 are formed at the opposite sides of the entrance 25 of the insertion path 24 on the upper surface of the housing 21. The guiding projections 32 extend from the entrance 25 of the insertion path 24 to a position beyond the left edge of the upper surface of the housing 21, and the FFC 10 and the folded cover 29 are fittable between the two guiding projections 32. Pressing protrusions 33 are formed on the facing surfaces of the projecting ends of the guiding projections 32 for pressing the opposite lateral edges of the folded cover 29 to lock the cover 29.

Figure 2:
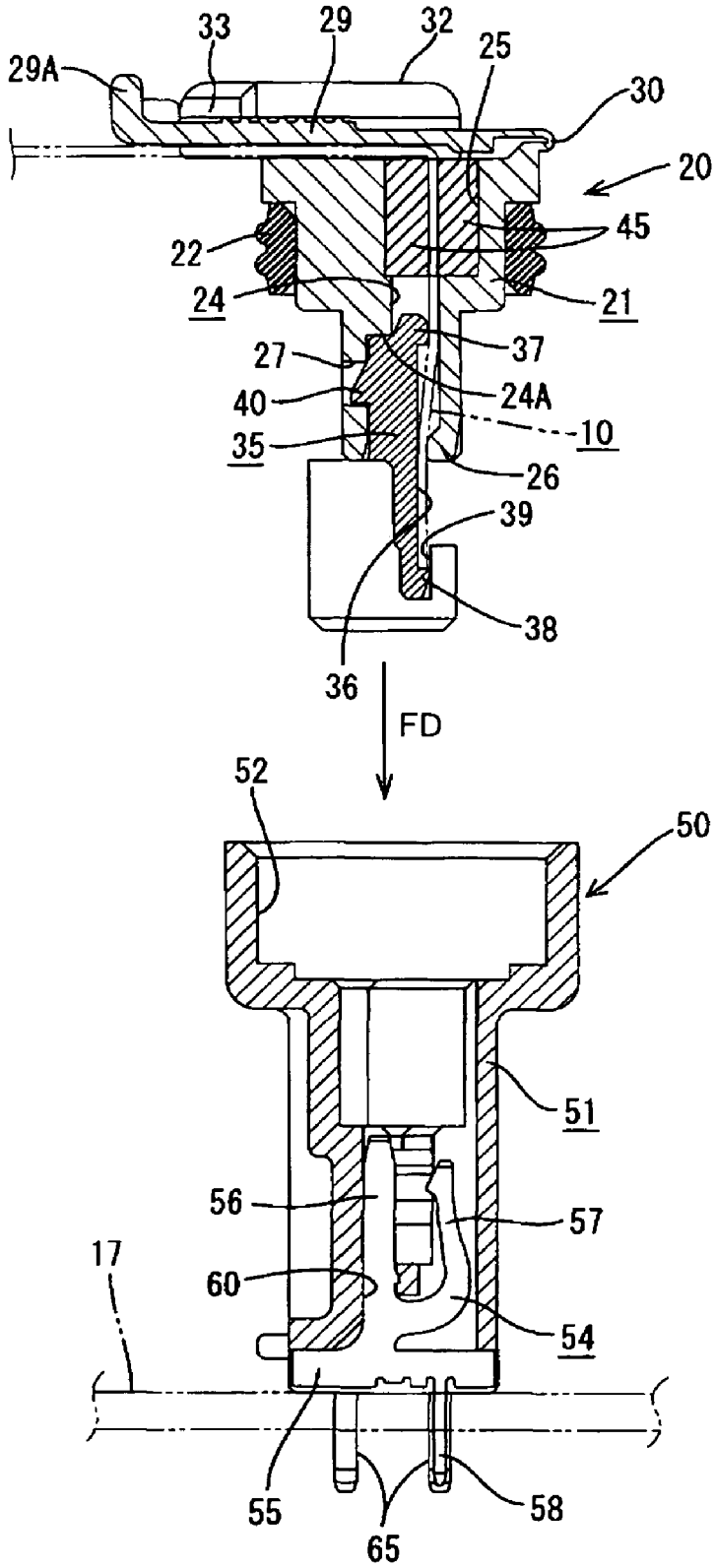
FIG. 2 is a section showing the state of FIG. 1.

The retainer 35 is mountable into a bottom side of the housing 21. The retainer 35 has a mounting surface 36 for the FFC 10, as shown in FIG. 2, and a rear portion of the retainer 35 is insertable into a lower side of the insertion path 24. A protrusion 37 is formed at the upper end of the mounting surface 36, and a contact 38 is formed at the bottom end of the mounting surface 36 for engaging the leading end of the FFC 10. Holding grooves 39 are formed at opposite sides of the contact 38 for receiving the respective projections 14 at the leading end of the FFC 10. A locking projection 40 is formed on a surface of the retainer 35 substantially opposite the mounting surface 36 and is fittable into the locking hole 27 of the insertion path 24.

The FFC 10 is inserted into the insertion path 24 of the housing 21, and gel plates 45 seal the entrance 25 of the insertion path 24.

Figure 5:
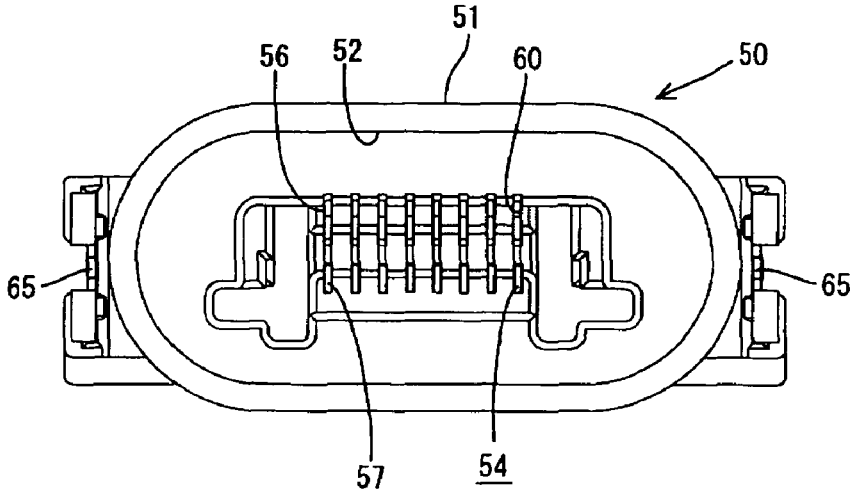
FIG. 5 is a plan view of the circuit board connector.

The circuit board connector 50 has a mating housing 51 made e.g. of a synthetic resin and mountable on the printed circuit board 17 or other electric or electronic device. An engaging recess 52 is formed in the upper surface of the mating housing 51, as shown in FIG. 5, for receiving the connector 20.

Terminal fittings 54 are accommodated at the bottom end of the engaging recess 52 at substantially the same intervals or pitch as the conductor paths 12 of the FFC 10. As shown in FIG. 2, each terminal fitting 54 has a wide base 55. An inserting piece 56 and a resilient contact piece 57 are formed to face each other on the upper surface of the base 55. Each terminal fitting 54 is mounted by pressing the inserting piece 56 into a groove 60 formed in a wall surface. A substantially tab-shaped connecting piece 58 projects from the bottom surface of the base 55.

Conductive metallic mounting pieces 65 are mounted on the outer shorter surfaces of the mating housing 51 and project down towards the printed circuit board 17.

The mating housing 51 is placed at a specified position on the printed circuit board 17 and is mounted by fitting the mounting pieces 65 into mount holes in the printed circuit board 17. The connecting pieces 58 of the terminal fittings 54 project through through holes from the underside of the printed circuit board 17 as the mating housing 51 is mounted and are connected with corresponding conductor paths by soldering, welding, ultrasonic welding, gluing with conductive glue, etc.

Figure 1:
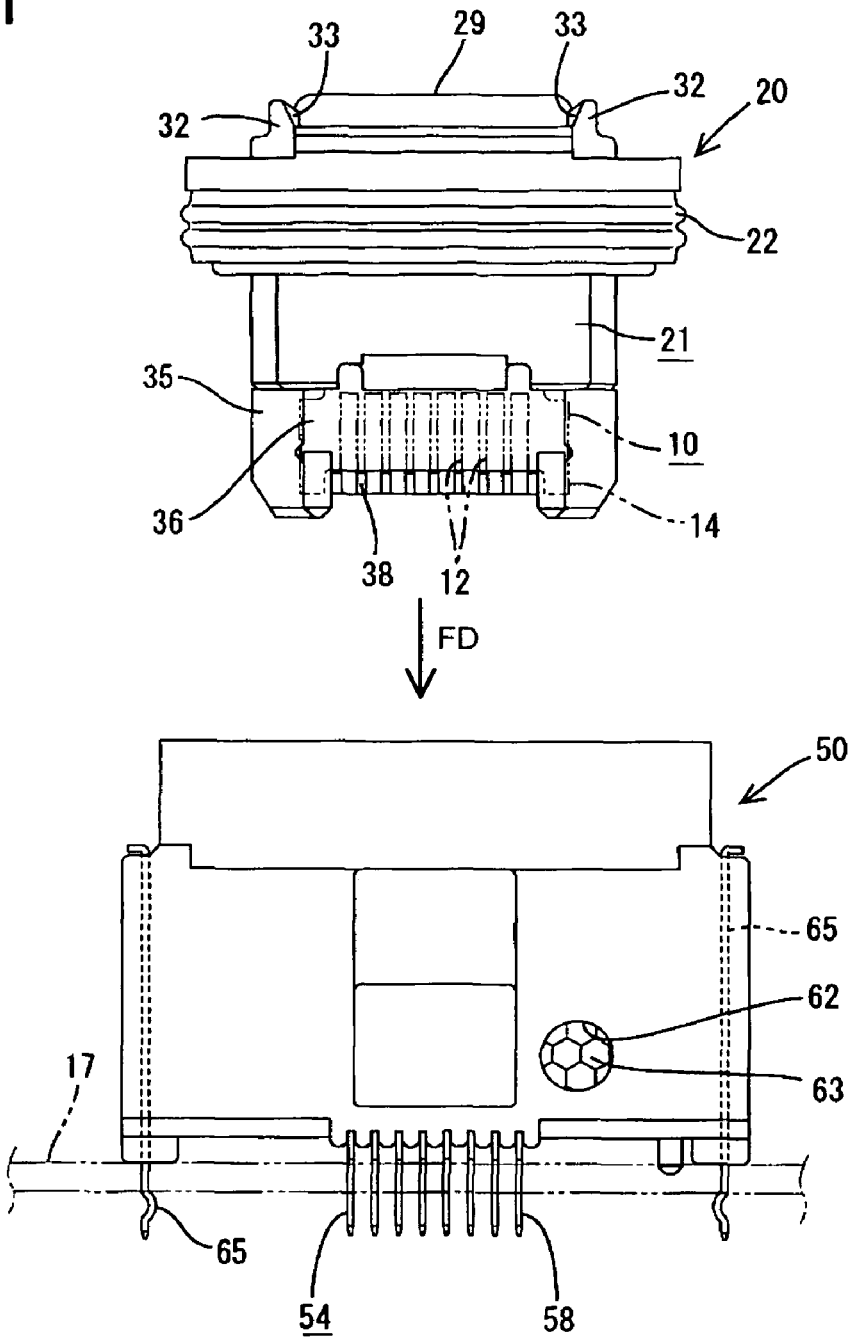
FIG. 1 is a front view showing a state before a connector for conductor-path sheet according to a first embodiment of the invention is connected with a circuit board connector.
Figure 8:
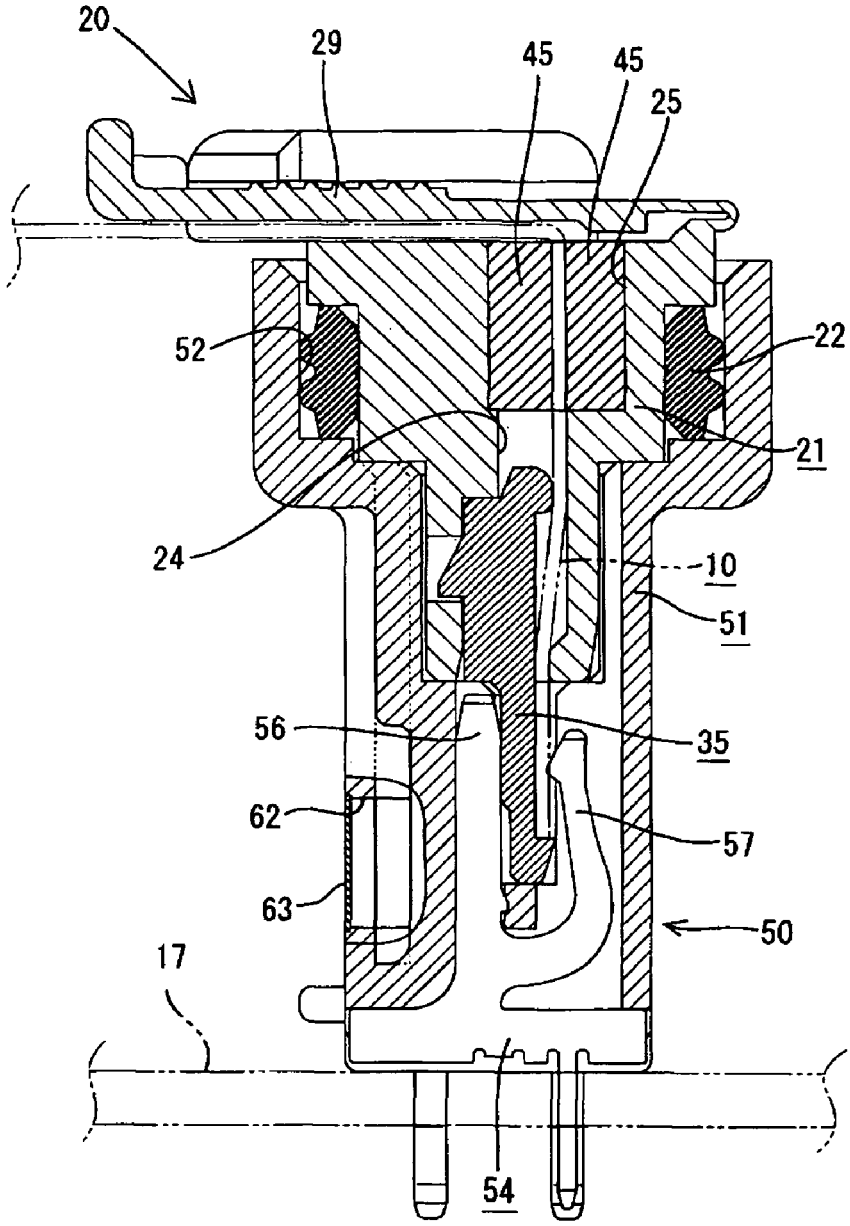
FIG. 8 is a section showing a state where the two connectors are connected.

As shown in FIGS. 1 and 8, a substantially round window 62, is formed in the mating housing 51 and communicates with the engaging recess 52. An air-permeable film 63, preferably made of Poreflon (microporous material made of a fluorocarbon resin), is attached to the window 62. The air-permeable film 63 shuts off the passage of liquids such as water and permits the passage of gases.

The connector 20 for conductor-path sheet is assembled by mounting the seal ring 22 on the outer peripheral surface of the middle stage of the housing 21, as shown in FIG. 3. The FFC 10 is held between two thick gel plates 45 made of gelatinous, elastic or resilient material at a position away from the end of the FFC 10 at a position behind the notches 15, as shown in FIG. 6. The gel plates 45 adhere to the FFC 10 due to their viscosity. A volume of the FFC 10 having the gel plates 45 thereon is larger than an inner volume of the entrance 25 of the insertion path 24. The gelatinous, elastic or resilient material may be a gel or elastic or rubbery material containing three dimensional cross-linked molecular formations or behave as if it contained such molecular formations (geloids). One example of a gel that can be used is silicone gel or resin. Another suitable gel comprises a block copolymer having relatively hard blocks (e.g. hydrogenated rubber blocks) examples of such copolymers including styrene-diene block copolymers (linear or radial) for example styrene-butadiene or styrene-isoprene diblock or triblock copolymers, or styrene-ethylene-butylene-styrenes triblock copolymers. The gel may be formed from a single liquid material that becomes a gel when subjected e.g. to radiation or chemicals. The gel may be formed from two components that become a gel when mixed; or the gel may be a composition that is a gel at working temperature, e.g. room temperature. Additionally or alternatively a gel material as disclosed in U.S. Pat. No. 4,875,870 may be used.

The end portion of the FFC 10 is inserted in an insertion direction ID into the insertion path 24 of the housing 21 so that the surface where the conductor paths 12 are exposed faces to the right side of FIG. 3. Thus, the gel plates 45 are pushed into the entrance 25 of the insertion path 24 and hold the FFC 10 therebetween. The retainer 35 then is pushed up substantially opposite to the inserting direction ID and into the bottom side of the insertion path 24 so that the projecting end of the FFC 10 is placed along the mounting surface 36 of the retainer 35.

The retainer 35 is pushed up into contact with a step 24A of the insertion path 24 as shown in FIG. 2. Thus, the locking projection 40 fits in the locking hole 27 to mount the retainer 35. The FFC 10 is held at two positions spaced along the longitudinal direction of the FFC 10 and along the inserting direction ID. More particularly, the FFC 10 is held between the protrusion 37 of the retainer 35 and the right wall surface of the insertion path 24 and between the protrusion 26 on the right wall surface of the insertion path 24 and the mounting surface 36 of the retainer 35. Simultaneously, the FFC 10 is held by inserting the projecting portions 14 into the holding grooves 39 and by engaging the contact portion 38 on the mounting surface 36 of the retainer 35 with the leading end of the FFC 10. The conductor paths 12 of the FFC 10 are exposed to the outside at positions below the bottom of the insertion path 24. As can be seen in FIGS. 2 and 8, the FFC 10 is bent slightly near its distal end due to the protrusion 26 so that the FFC 10 has a slight zig-zag or undulated shape which can advantageously assist proper positioning of the FFC 10 with respect to the retainer 35 and/or the housing 21.

Figure 7:
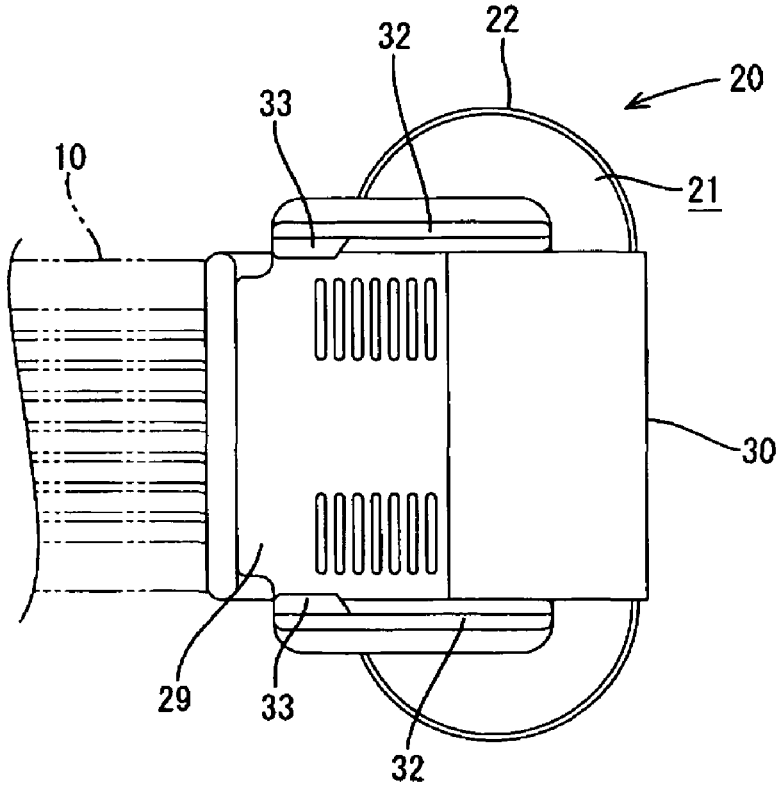
FIG. 7 is a plan view of the connector for conductor-path sheet.

When the mounting of the retainer 35 is completed, a portion of the FFC 10 projecting out from the entrance 25 of the insertion path 24 is bent substantially at a right angle with respect to the inserting direction ID preferably to extend along the upper surface of the housing 21 and is fit between the two guiding projections 32. The open cover 29 then is pivoted at the hinge 30 and fit between the two guiding projections 32 to press the FFC 10 against the upper surface of the housing 21. The cover 29 is held by the pressing protrusions 33 as shown in FIG. 7. In this way, the assembling of the connector 20 for conductor-path sheet is completed.

The circuit board connector 50 is mounted on the printed circuit board 17 as described above, and the connector 20 is fit into the engaging recess 52 of the mating housing 51 in the fitting direction FD as indicated by an arrow in FIG. 2. Accordingly, the bottom end of the retainer 35 is inserted between the inserting pieces 56 and the resilient contact pieces 57 of the terminal fittings 54. Additionally, the resilient contact pieces 57 of the respective terminal fittings 54 are brought resiliently into contact with the corresponding exposed conductor paths 12 of the FFC 10 to electrically connect the corresponding terminal fittings 54 and conductor paths 12 as shown in FIG. 8.

The seal ring 22 mounted on the housing 21 is fit and resiliently compressed by the inner peripheral surface of the engaging recess 52 of the mating housing 51 to provide sealing between the two housings 21, 51.

The two thick gel plates 45 are mounted on the front and rear surfaces of the FFC 10, and the assembly of the gel plates 45 and the FFC 10 is fit into the entrance 25 of the insertion path 24. Thus, waterproofing is achieved where the end portion of the FFC 10 is inserted into the insertion path 24 of the housing 21. The gel plates 45 adhere well even to the corners of the end portion of the FFC 10, thereby displaying a good waterproof function and enabling the FFC 10 to be used at a place exposed to water. The gel plates 45 are mounted on the FFC 10 beforehand and are fit in the inserting direction ID into the entrance 25 of the insertion path 24 as the FFC 10 is inserted into the housing 21. Thus, an assembling procedure is simplified.

The seal ring 22 provides a sealed space between the two housings 21, 51. A temperature difference between the inside and the outside of the housings 21, 51 in this state could cause air in the sealed space to expand or contract and could cause the housings 21, 51 to deform. Such deformation could create clearances between the gel plates 45, the entrance 25 of the insertion path 24 and adhered portions of the FFC 10. However, air passes through the air-permeable film 63 in response to a temperature difference between the inside and the outside of the connectors 20, 50. Accordingly, air neither expands nor contacts in the sealed space, and the housings 21, 51 will not deform. Thus, the gel plates 45 maintain a sufficient adherence. The air-permeable film 63 hinders the entrance of water, and the waterproofed state between the two housings 21, 51 is maintained.

Figure 9A:
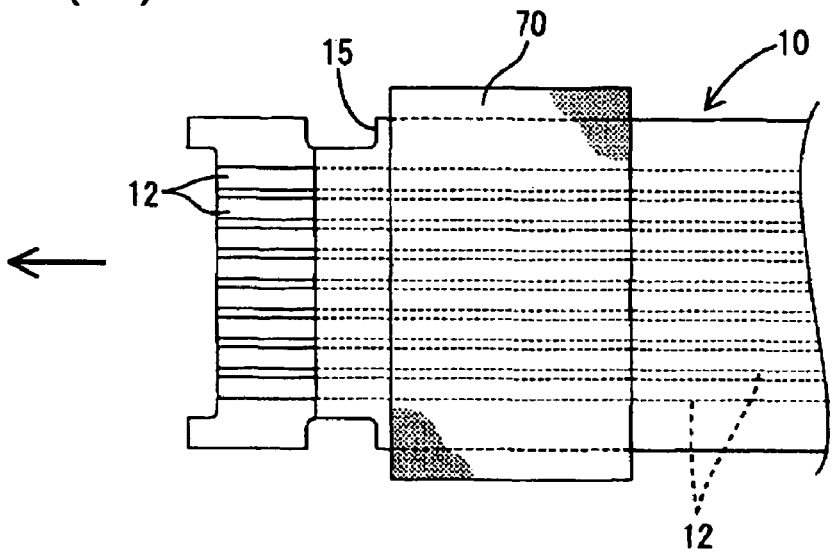
FIG. 9(A) is a plan view of the FFC having a rubber ring according to a second embodiment of the invention mounted thereon.
Figure 9B:
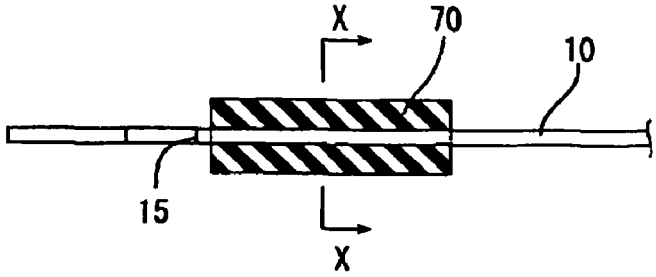
FIG. 9(B) is a side view partly in section of the FFC of FIG. 9(A)
Figure 9C:
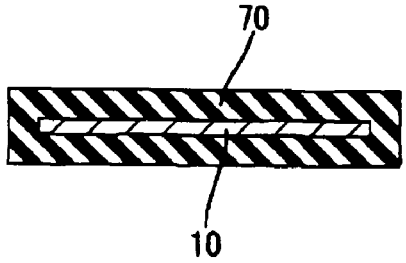
FIG. 9(C) is a section along 9C—9C of FIG. 9(B).

FIGS. 9(A), 9(B) and 9(C) show a second embodiment of the invention. In the second embodiment, a resilient rubber ring 70 is molded on the FFC 10 at a specified distance from the end. The rubber ring 70 is fit in the inserting direction ID into the entrance 25 of the insertion path 24. The molding affixes the rubber ring 70 well to the outer peripheral surface of the FFC 10 including corners. However, the rubber ring 70 also may be adhered to the FFC 10 by means of an adhesive, glue or the like. Effects similar to those of the first embodiment including secure waterproofing can be obtained.

Figure 10A:
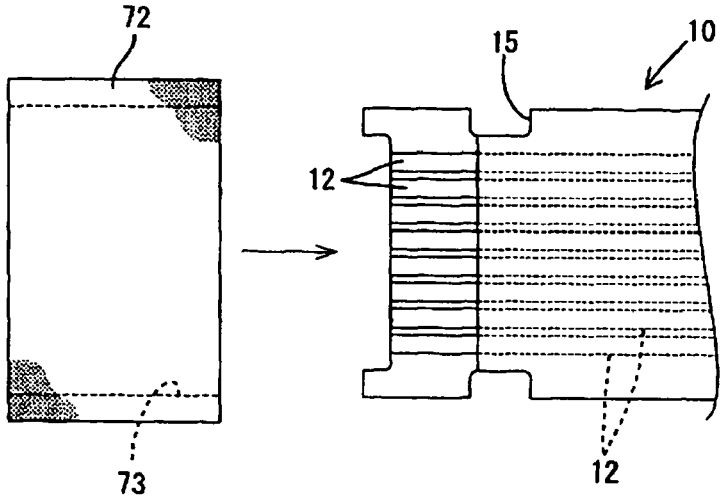
FIG. 10(A) is a plan view showing an operation of mounting a ring member according to a third embodiment of the invention on the FFC.
Figure 10B:
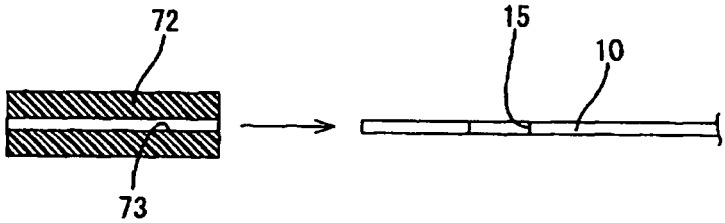
FIG. 10(B) is a side view partly in section showing the state of FIG. 10(A)
Figure 10C:
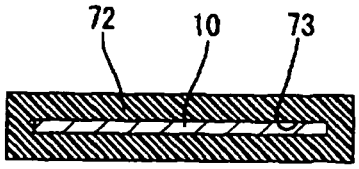
FIG. 10(C) is a section of the FFC having the ring member mounted thereon.

FIGS. 10(A), 10(B) and 10(C) show a third embodiment of the invention. In this third embodiment, a ring 72 made of a thermoplastic elastomer or other resilient material is formed with an insertion opening 73 into which the end portion of the FFC 10 is insertable. Heating is applied with the end portion of the FFC 10 inserted in the insertion opening 73 of the ring 72. Thus, the inner peripheral surface of the insertion opening 73 is molten and adheres to the outer surface of the end portion of the FFC 10. The ring 72 is fit in the inserting direction into the entrance 25 of the insertion path 24.

The ring 72 is made of a thermoplastic elastomer, and can be molten and adhered well to the outer peripheral surface of the end portion of the FFC 10 including corners. Thus, effects similar to the first embodiment are obtained.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The connector housing may not be provided with the cover and a means other than or in addition to the retainer may be used to fix the FFC.

The invention is not limited to application to the FFC illustrated in the foregoing embodiments. In short, the invention is suitably applicable to connectors used to accommodate an end portion of a conductor-path sheet preferably having a substantially rectangular cross section.

What is claimed is:

1. A connector comprising:

a housing having opposite front and rear ends and an insertion path extending through the housing from the front end to the rear end, the insertion path having an insertion opening open widely at the rear end of the housing;

a conductor-path sheet having an end, an insulating sheet extending from the end and a plurality of conductor paths arranged on the insulating sheet, a seal mounted on an outer peripheral surface of the conductor-path sheet beforehand at locations spaced from the end, the end of the conductor-path sheet being accommodated in the insertion path of the housing sufficiently for the seal to fit in close contact with inner peripheral surfaces of the insertion opening; and a retainer mounted in the insertion path forward of the insertion opening and holding the conductor-path sheet against the housing.

2. The connector of claim 1, wherein the seal comprises gel plates tightly mounted on front and rear surfaces of the end portion of the conductor-path sheet.

3. The connector of claim 1, wherein the seal comprises a resilient ring formed on the outer peripheral surface of the end portion of the conductor-path sheet by molding.

4. The connector of claim 1, wherein the seal comprises a ring made of a thermoplastic elastomer and formed with an introducing opening through which the end portion of the conductor-path sheet is introduced.

5. The connector of claim 4, wherein at least the inner peripheral surface of the introducing opening of the ring is melted into adherence with the outer peripheral surface of the conductor-path sheet.

6. The connector of claim 1, further comprising a seal ring for forming a sealed space between the housing and a mating housing.

7. The connector of claim 6, wherein an opening is formed in an outer surface of at least one of the housing and the mating housing for communicating with a sealed space between the two housings, and an air-permeable film is provided at the opening for permitting passage of gases while shutting off passage of fluids.

8. The connector of claim 1, wherein the conductor-path sheet is fixed in the housing while being held at two positions spaced along a longitudinal direction of the conductor-path sheet between portions of the retainer and the housing.

* * * * *